US005795241A

United States Patent [19]

Peshek

[11] Patent Number: 5,795,241

[45] Date of Patent: Aug. 18, 1998

[54] GOLF PUTTER HAND GRIP

[75] Inventor: Andrew W. Peshek, 2825 N. Austin, Chicago, Ill. 60634

[73] Assignees: Andrew W. Peshek; Maria S. Peshek, both of Chicago, Ill.

[21] Appl. No.: 787,409

[22] Filed: Jan. 21, 1997

Related U.S. Application Data

[63] Continuation of Ser. No. 440,677, May 15, 1995, abandoned.

[51] Int. Cl.[6] ..... A63B 53/14

[52] U.S. Cl. ..... 473/300; 473/201

[58] Field of Search ..... 473/294, 295, 473/296, 297, 298, 299, 300, 302, 303, 201, 203, 204; D21/214, 217

[56] References Cited

U.S. PATENT DOCUMENTS

| | | | |
|---|---|---|---|
| 2,086,974 | 7/1937 | Belfore | 273/165 |
| 2,445,718 | 7/1948 | Sternberg et al. | |
| 2,873,970 | 2/1959 | Murphey, Jr. | |
| 2,949,304 | 8/1960 | Williams | |
| 3,077,349 | 2/1963 | Leonard | 273/81.4 |
| 3,123,359 | 3/1964 | Lindgren | |
| 3,245,686 | 4/1966 | Hartmeister | |
| 3,263,998 | 8/1966 | Fanning | 273/81.4 |
| 3,326,554 | 6/1967 | Scully | |
| 3,459,426 | 8/1969 | Sherwood | |
| 4,067,573 | 1/1978 | Key, Jr. | 273/81.4 |
| 4,215,860 | 8/1980 | Nakamatsu | 273/81 R |
| 4,625,965 | 12/1986 | Mullins | |

*Primary Examiner*—Steven B. Wong
*Attorney, Agent, or Firm*—Dick and Harris

[57] ABSTRACT

A golf putter hand grip being so shaped that the golfers two palms remain flat and parallel to each other and the striking face portion of the club head while the fingers and thumb secure the grip in a natural manner.

6 Claims, 2 Drawing Sheets

20
32
36
22
34
30
28
26
36
24
17

20
40
22
28
17
10
12

18
14
16
20
32
36
34
22
30
41
28
26
24
17
12

14
18
16
15

GOLF PUTTER HAND GRIP

This is a continuation of application Ser. No. 08/440,677, filed May 15, 1995, now hereby abandoned.

BACKGROUND

1. Field of Invention

This invention relates to a novel and unique golf club grip, specifically an improved putter hand grip.

2. Description of Prior Art

Despite the difference in function between the putter and other golf clubs, the manner of gripping the putter has followed that of other clubs. In general the conventional golf club putter includes a grip portion of a circular or elongated cross-section which is mounted on the shaft. A golfer generally grasps the grip portion with both hands, which are positioned one after another along the length of the grip portion. With a delicate and highly accurate movement being the primary attributes, this grasping condition creates an unnatural attitude. In another less popular but approved design the golfer faces the hole and swings the putter between his legs in the manner of a croquet mallet. Putting successfully, using this unorthodox style, is very difficult regardless of the shape of the putter grip.

OBJECTS AND ADVANTAGES

The accuracy of a golfers putt is governed by the ability to "read" the surface of the green correctly while the putter is used to impart the necessary speed and direction to a golf ball to cause it to roll across a portion of the, rarely level green, into the cup.

Accordingly, to improve the mental and physical aspects of this task, several objects and advantages of this invention are:

(a) To provide a novel and unique golf putter hand grip by means of which any unskilled golfer can putt the ball with more accurate orientation.

(b) To provide a novel and unique golf putter hand grip wholly avoiding the usual encircling of the grip by the fingers and hands.

(c) To provide a novel and unique golf putter hand grip and still maintain a "professionally" proven and proper putting stroke.

Further objects and advantages of my invention will become apparent from a consideration of the drawings and ensuing description.

SUMMARY OF THE INVENTION

The present invention is directed to a golf putter hand grip for use in association with a golf putter. The golf putter is of the type including a shaft which has a first end and a second end, a diameter and a longitudinal axis. A club head is positioned at the second end of the shaft. The club head includes a club face for hitting a golf ball. The golf putter hand grip is positioned at the first end of the shaft.

The golf putter hand grip includes a first palm surface and a second palm surface. The first palm surface is substantially planar and substantially parallel to the club face. Likewise, the second palm surface is opposite and parallel to the first palm surface. The first and second palm surfaces are separated by a uniform thickness and, as such, the first palm surface is positioned on an immediate side of the shaft and the second palm surface is positioned on an immediate second, opposite side of the shaft. In a preferred embodiment, the uniform thickness between the first and second palm surfaces is greater than the diameter of the shaft.

In a preferred embodiment, the first palm surface includes a co-planar first forefinger extension region for prompting the positioning and receipt of a golfer's extended left forefinger while isolating the right forefinger from the shaft. In this embodiment, the second palm surface likewise includes a co-planar second forefinger extension region for prompting the positioning and receipt of a golfer's extended right forefinger, while isolating the left forefinger from the shaft. In this preferred embodiment, each of the forefinger extensions are co-planar with their respective palm surface and parallel to each other; so as to overly the longitudinal axis of the shaft on opposite sides thereof.

In the preferred embodiment, the golf putter hand grip further includes a grip fold region which is operably positioned between the first and second palm surfaces. The grip fold region has a uniform, continuous, peripheral configuration for accommodating, through substantially linear receipt, the respective ring finger, middle finger and pinky finger of each hand of a golfer—in either an interlocking or overlying finger engagement orientation. Preferably, the grip fold region is parallel to the base of the club head.

In a preferred embodiment, the first and second palm surfaces further include a wrist extension region at their rearward periphery, for the aligned planar receipt of a golfer's rear palm region immediately abutting the wrist. This facilitates placement of the entirety of both hands of the golfer in a parallel, planar environment.

In another preferred embodiment, each wrist extension region comprises an arcuate configuration that remains co-planar with and extends from a respective palm surface along the rearward periphery of the golf putter hand grip.

DRAWING FIGURES

DETAILED DESCRIPTION OF THE DRAWINGS

Figures 1, 2, 3:
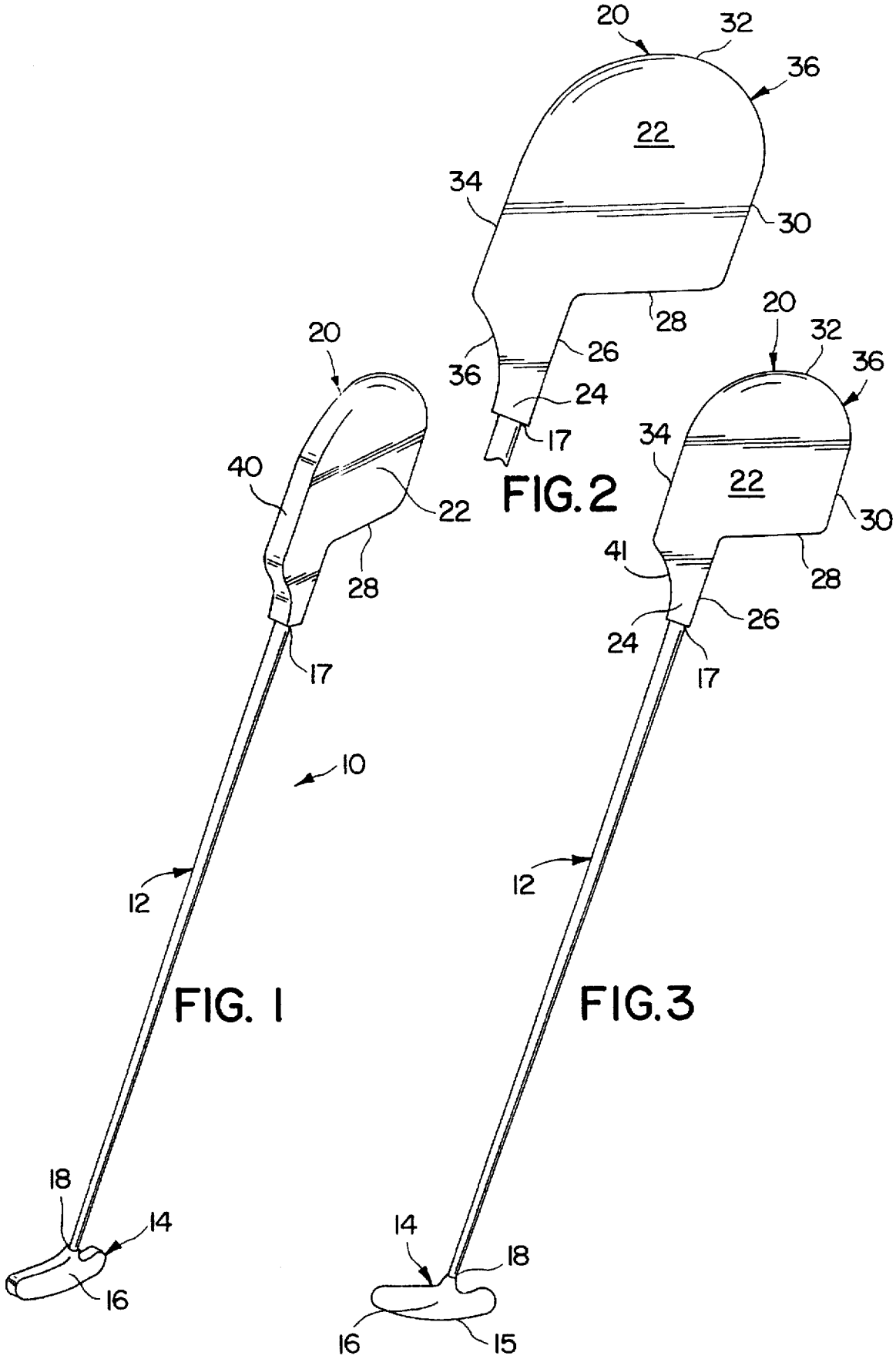
FIG. 1 is a perspective view of the golf putter hand grip.
FIG. 2 is a fragmentary side view of the golf putter hand grip.
FIG. 3 is a side view of the golf putter hand grip.

While this invention is susceptible of embodiment in many different forms, there is shown in the drawings, and will herein be described in detail, one specific embodiment with the understanding that the present disclosure should be considered as an exemplification of the principles of the invention and is not intended to limit the invention to the embodiment illustrated.

Figure 5:
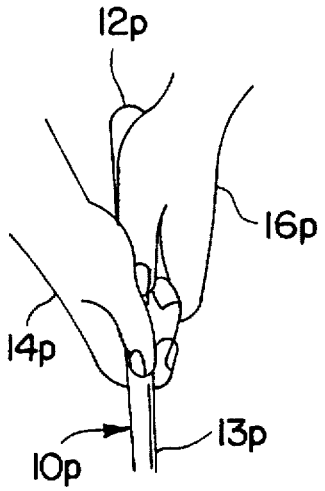
FIG. 5 PRIOR ART
FIG. 5 is a fragmentary front view showing the grip portion of a conventional golf putter which is grasped by the right and left hands disposed one after another.

Prior to the description of my invention, a conventional golf putter will be described with reference to FIG. 5.

In general, the conventional golf club putter 10P includes a grip portion 12P of a circular or elongated cross-section, which is mounted on shaft 13P. As shown in FIG. 5, a golfer generally grasps the grip portion 12P by his/her right hand 14P and left hand 16P, which are positioned one after another along the length of the grip portion 12P. When the cylindrical grip portion 12P of the golf putter constitutes the only hand gripping surface, two hands 14P and 16P must be in tandem to each other in order that both of them can grasp grip portion 12P.

Figure 4:
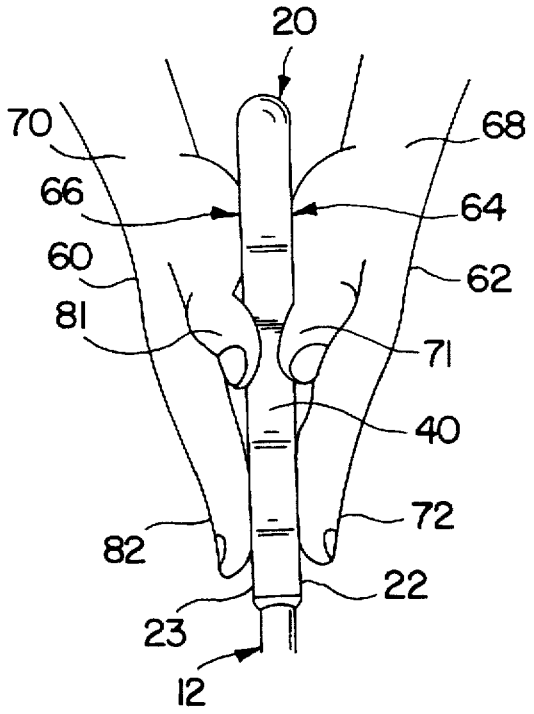
FIG. 4 is a fragmentary front view of the golf putter hand grip in use, showing the position of the hands.
Figure 6:
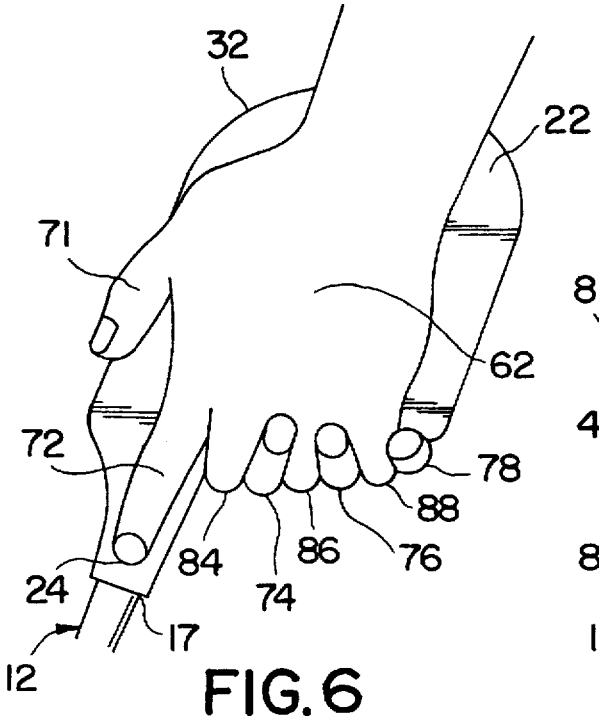
FIG. 6 is a fragmentary side view of the golf putter hand grip in use, showing the position of the hands.
Figure 7:
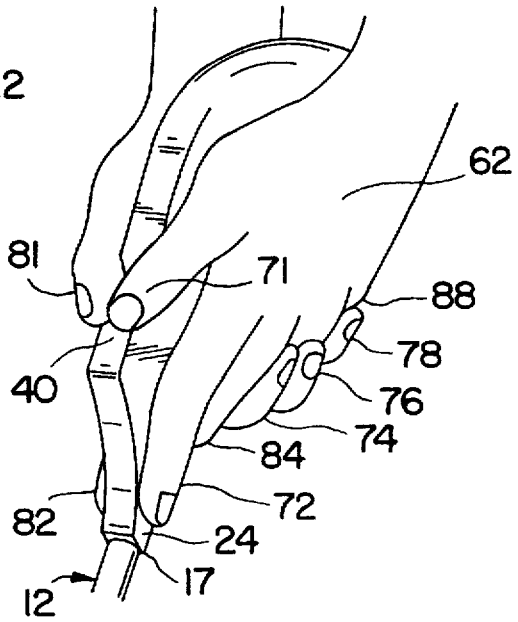
FIG. 7 is a fragmentary perspective view of the golf putter hand grip in use, showing the position of the hands.

In order to overcome the unnatural attitude created by this grasping condition, a golf putter hand grip 20, according to my invention is shown in FIGS. 1, 2 and 3, while the technique in holding the putter grip 20 is illustrated in FIGS. 4, 6 and 7. The grip 20 is such that it includes two opposite palm surfaces, parallel to club face 16 of the club head 14, which faces toward the golf ball. The hands 60 and 62, parallel to each other, are placed flat against each side 23, 22, respectively of said grip 20. Three fingers 74, 76, 78 and 84, 86, 88 on each hand 60 and 62 interlock, firmly holding grip fold region 28. Each forefinger 72 and 82 is fully extended pointing downward against the sides of the forefinger extension region 24 and the thumbs 71 and 81 will gently secure said grip 20 on thumb fold region 24.

Golf club 10 is shown in FIGS. 1–3 as including golf putter hand grip 20, shaft 12 and club head 14. As shown, shaft 12 includes first end 17 and second end 18. Golf putter hand grip 20 is positioned at first end 17 of shaft 12. Club head 14 is positioned at second end 18 of club head 14. Club head 14 includes club face 16, which is the portion of the golf club that contacts a golf ball during use of the invention, together with club base 15.

Golf putter hand grip 20 includes first palm surface 22, second palm surface 23 (as shown in FIG. 4), and grip perimeter 36. First palm surface 22 is parallel to and aligned with second palm surface 23. Likewise, first palm surface 22 and second palm surface 23 are each parallel to club face 16. Both of the palm surfaces are contiguous and substantially flat and planar. The two, parallel palm surfaces are separated from one another to impart a grip thickness 40 which, in turn, is uniform along the entirety of grip perimeter 36. Thickness 40 is contemplated as measuring 13/16" when the grip receives a standard putter shaft 12, typically 9/16" in diameter. However, other dimensions are also contemplated towards co-operation with other standard or non-standard size shafts.

Grip perimeter 36 includes rear shaft region 26, grip fold region 28, back region 30, wrist extension region 32, thumb fold region 34, front shaft region 41 and forefinger extension region 24. Rear shaft region 26 is parallel to the axis of shaft 12. Grip fold region 28 is substantially uniform and is of sufficient length to accommodate a golfer's middle finger, ring finger and pinky finger, all as shown in FIGS. 4, 6 and 7. Grip fold region 28 may be positioned parallel to base 15 of club head 16. At least a portion of back region 30 is substantially parallel to the axis of shaft 12. Wrist extension region 32 is generally of an arcuate configuration, extending uniformly along the top of golf putter hand grip 20—from back region 30 to thumb fold region 34.

Thumb fold region 34 is likewise substantially parallel to the axis of shaft 12. Forefinger extension region 24 is positioned between front shaft region 36 and rear shaft region 26; and is sufficiently dimensioned to locate, align and receive the golfer's extended forefinger (when the remaining fingers are properly disposed about grip fold region 28).

In operation, and as shown in FIGS. 4, 6 and 7, the structural features of the present invention prompt a golfer to position his/her palm 64 of left hand 62 onto first palm surface 22 of golf putter hand grip 20. Likewise, the golfer is prompted to position palm 66 of right hand 60 onto second palm surface 23. Right and Left wrists 70 and 68, respectively, become oriented proximate to wrist extension region 32 of perimeter 36. Of course, it is contemplated that either palm may be positioned before the other palm, in using the device, or both may be positioned simultaneously.

Once the palms have been properly positioned, middle finger 74, ring finger 76 and pinky finger 78 of right hand 60 are positioned about grip fold region 28. Middle finger 84, ring finger 86 and pinky finger 88 of left hand 62 are positioned in overlying and/or interlocking engagement with the same respective fingers of right hand 60 about grip fold region 28. The device operates equivalently regardless of whether fingers of the right and left hand may overly one another, or alternatively interlockingly engage each other.

Unlike the three fingers of each hand that are folded about grip fold 28, forefinger 72 of left hand 62 is positioned on forefinger extension region 24 of first palm surface 22. Likewise forefinger 82 of right hand 60 is positioned on the corresponding forefinger extension region of second palm surface 23. Right and left thumbs 81 and 71, respectively, are then positioned on thumb fold region 34; which extends between wrist extension region 32 and front shaft region 41 of perimeter 36. As shown in FIG. 6, right thumb 81 and left thumb 71 may also remain substantially positioned on second palm surface 23 and first palm surface 22, respectively.

From the description above, a number of advantages of the golf putter hand grip become evident, namely, that it has a comfortable feel, it assures a natural attitude, it assists in preventing the twisting of the wrists, it establishes an accurate orientation, and it encourages a proper putting stroke.

Ramifications and Scope

While the preferred embodiments of the invention have been described with reference to the accompanying drawings, this should not be construed as limiting the scope of the invention but as merely providing illustrations of some of the presently preferred embodiments of this invention. For example, the upper front (thumb) area could be made to fit any hand size of a particular golfer.

Thus the scope of the invention should be determined by the appended claims and their legal equivalents.

I claim:

1. A golf putter hand grip, for a golf putter of the type including a shaft having a first end, a second end, a diameter, a longitudinal axis therethrough, and a club head including a base and a club face for hitting a golf ball, said golf putter hand grip being positionable at the first end of the shaft said golf putter hand grip comprising:

a first palm surface, said first palm surface being positionable substantially planar and substantially parallel to the club face and positionable on an immediate first side of the shaft;

a second palm surface, said second palm surface being opposite and parallel to said first palm surface, and separated from said first palm surface by a uniform thickness so as to be positionable on a second, opposite immediate side of the shaft;

a grip fold region operably positioned between said first and said second palm surfaces, said grip fold region being positionable substantially parallel to the base, said grip fold region having a substantially linear uniform, continuous, peripheral configuration for accommodating, through substantially linear receipt, the respective ring finger, middle finger and pinky finger of each hand of a golfer, in at least one of an interlocking and overlying finger engagement orientation.

2. The golf putter hand grip according to claim 1 wherein the thickness of said golf putter hand grip is greater than the diameter of the shaft.

3. The golf putter hand grip according to claim 1 in which:

said first palm surface further includes a co-planar first forefinger extension region for prompting the positioning and receipt of the golfer's extended left forefinger while isolating said golfer's right forefinger from the shaft of the golf putter; and said second palm surface further including a co-planar second forefinger extension region for prompting the positioning and receipt of a golfer's extended right fore-finger while isolating a golfer's left forefinger from the shaft.

4. The golf putter hand grip according to claim 3 in which each of said forefinger extension regions is substantially co-linear, parallel to, and overlays the longitudinal axis of the shaft.

5. The golf putter hand grip according to claim 1 in which said first and said second palm surfaces include a first and second wrist extension region respectively, at their rearward periphery, for the aligned planar receipt of a golfer's rear palm region immediately abutting a wrist, so as to facilitate placement of the entirety of both hands of said golfer on said golf putter hand grip.

6. The golf putter hand grip according to claim 5 in which said first and second wrist extension regions collectively comprise an arcuate configuration extending along said rearward periphery of said golf putter hand grip.

* * * * *